US006209803B1

(12) United States Patent
Colo'n

(10) Patent No.: US 6,209,803 B1
(45) Date of Patent: Apr. 3, 2001

(54) LAWN SPRINKLER HEAD PROTECTOR SHIELD

(76) Inventor: Arthur D. Colo'n, 13146 Fall Manor Dr., Dallas, TX (US) 75243

( * ) Notice: Subject to any disclaimer, the term of this patent is extended or adjusted under 35 U.S.C. 154(b) by 0 days.

(21) Appl. No.: 09/123,212

(22) Filed: Jul. 27, 1998

Related U.S. Application Data

(63) Continuation-in-part of application No. 08/777,491, filed on Dec. 30, 1996, now abandoned.

(51) Int. Cl.[7] ..... B05B 1/28; B05B 15/04
(52) U.S. Cl. ..... 239/288.5
(58) Field of Search ..... 239/201–203, 239/288.3, 288.5

(56) References Cited

U.S. PATENT DOCUMENTS 2,080,341 * 5/1937 Shuumacher ..... 239/201
3,015,448 * 1/1962 Hurless ..... 239/201
3,904,120 * 9/1975 Sbicca ..... 239/288.5 X
4,582,256 * 4/1986 Jaquez ..... 239/288.5
5,102,048 * 4/1992 Bohnoff ..... 239/288.3 X
5,951,000 * 9/1995 Shaw et al. ..... 239/201 X

* cited by examiner

*Primary Examiner*—Andres Kashnikow
*Assistant Examiner*—Davis Hwu
(74) *Attorney, Agent, or Firm*—John E. Vandigriff

(57) ABSTRACT

The invention is a lawn sprinkler head protector that is placed around the sprinkler head and pressed into the grass and/or soil in which the sprinkler head is located. The protector has multiple nesting center inserts. Inserts may be moved to accommodate the size of the sprinkler head. The top surface of the protector has patterned indentations which resemble grass leaves. The top surface is also textured to provide a non-slip surface. A plurality of openings extend around the surface to provide opening through which grass can grow to hide the protector. The lower edges as well as the plurality of openings have a taper edge which provides a cutting edge which helps the protector to cut through grass and soil as it is pressed into the ground around a sprinkler head.

17 Claims, 10 Drawing Sheets

LAWN SPRINKLER HEAD PROTECTOR SHIELD

This application is a CIP of Ser. No. 08/777,491 filed Dec. 30, 1996 now abandoned.

FIELD OF THE INVENTION

The invention relates in general to pop-up lawn sprinkler systems and more particularly to a protector shield, for lawn sprinkler heads, which have nested inserts which may be removed to accommodate sprinkler heads of different sizes.

DESCRIPTION OF RELATED ART

Pop-up lawn sprinkler heads are attached to underground water lines, and are normally located below ground level. When the water is turned on, the head pops-up out of the ground, so that water can be sprayed onto the lawn.

If the sprinkler heads are not protected, they may be damaged or broken by being run over by lawn mowers or automobiles. Damaged and broken sprinkler heads can be expensive to repair, and water may be leaked until the head is fixed.

Many prior art sprinkler head protector shields have been difficult to install or inadequate to protect the heads or inhibit grass growth. The complexity of other protectors makes it impractical for the average homeowners to buy and install the devices by themselves.

Also, most prior art sprinkler head protector do not blend into the lawn. Most are metallic and are brightly colored, so they detract from the appearance of the lawn.

Prior art sprinkler head protectors are usually quite slick, especially when wet, as they often are. If a person steps on a protector shield, the person would likely slip and fall down.

SUMMARY OF THE INVENTION

The invention is a lawn sprinkler head protector that is placed around the sprinkler head and pressed into the grass and/or soil in which the sprinkler head is located, and also inhibits the growth of grass adjacent to the sprinkler head. The protector has nested center inserts that may be used in combination or some removed depending upon the size of the sprinkler head.

The top surface of the protector has patterned indentations which resemble grass leaves. The top surface is also textured to provide a non-slip surface.

A plurality of openings extend around the surface to provide opening through grass can grow to completely hide the protector. The lower edges as well as the plurality of openings have a taper edge which provides a cutting edge which helps the protector to cut through grass and soil as it is pressed into the ground around a sprinkler head, and no digging is required.

The technical advance represented by the invention, as well as the objects thereof, will become apparent from the following description of a preferred embodiment of the invention when considered in conjunction with the accompanying drawings, and the novel features set forth in the appended claims.

DESCRIPTION OF A PREFERRED EMBODIMENT

Figure 1:
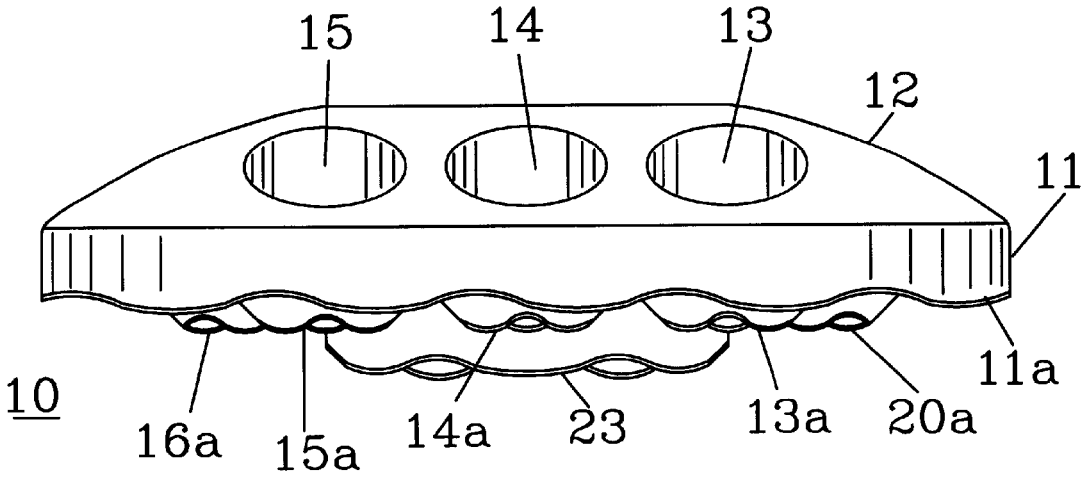
FIG. 1 is a side view of the present invention.

FIG. 1 is a side view of sprinkler head protector 10 which may be, for example, a molded plastic part having green color to match that of grass growing around it. Protector 10 has a single opening 28 centrally located in its center (see FIG. 4). Also extending through protector 10 are a plurality of openings 13–20 of which 13–15 are visible in FIG. 1. Each of openings 28 and 13–20 extend through protector 10 and end in tapered ends that form a cutting edge. The ends are also irregular or scalloped to improve ground penetation. In FIG. 1, the scalloped tapered edges 13*a*, 14*a*, 15*a*, 16*a* and 23 are shown, where edges 13*a*–16*a* are on openings 13–16 respectively, and edge 23 is on opening 28. The vertical outer side 11 of protector 10 has a tapered and scalloped edge 11*a*. The vertical outer side also entraps soil and grass runners under the shield allowing it to utilize the soil and grass as a shock absorber.

Figure 2:
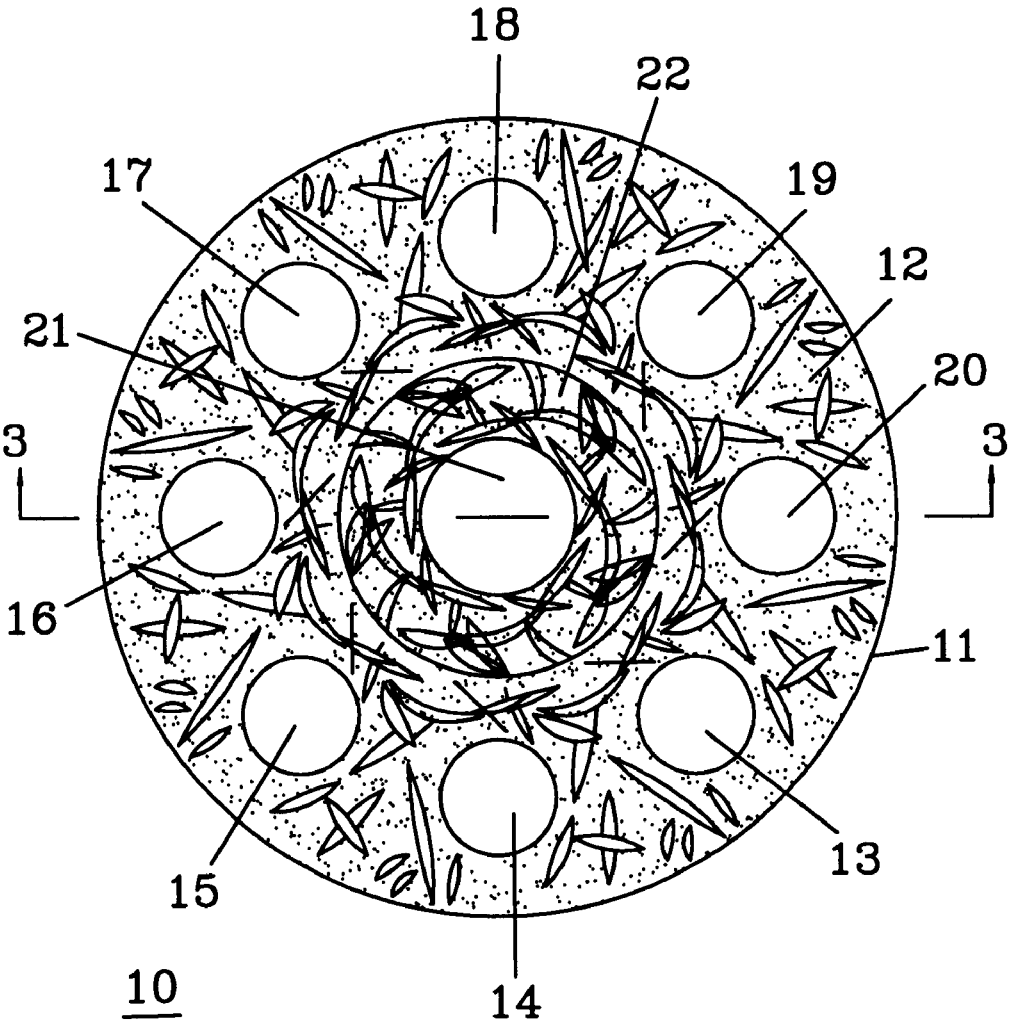
FIG. 2 is a top view of the present invention.

In FIG. 2, the patterned and textured top surface 12 of protector is shown. Protector 10 has an opening 28 centrally located in its center which has at least one removable insert 22 therein. Insert 22 is removable and has an opening 21 therein in which resides a sprinkler head when protector 10 has been placed around a sprinkler head. As described in FIG. 3 below and illustrated FIG. 3, additional inserts may be used to accommodate smaller diameter sprinkler heads. All of the plurality of openings 13–20 are shown as well as opening 21 in insert 22. The pattern in the surface 12 is to resemble grass and the exact pattern may vary for different protectors so that some resemble, for example, grasses such as Bermuda and St. Augustine.

Figure 3:
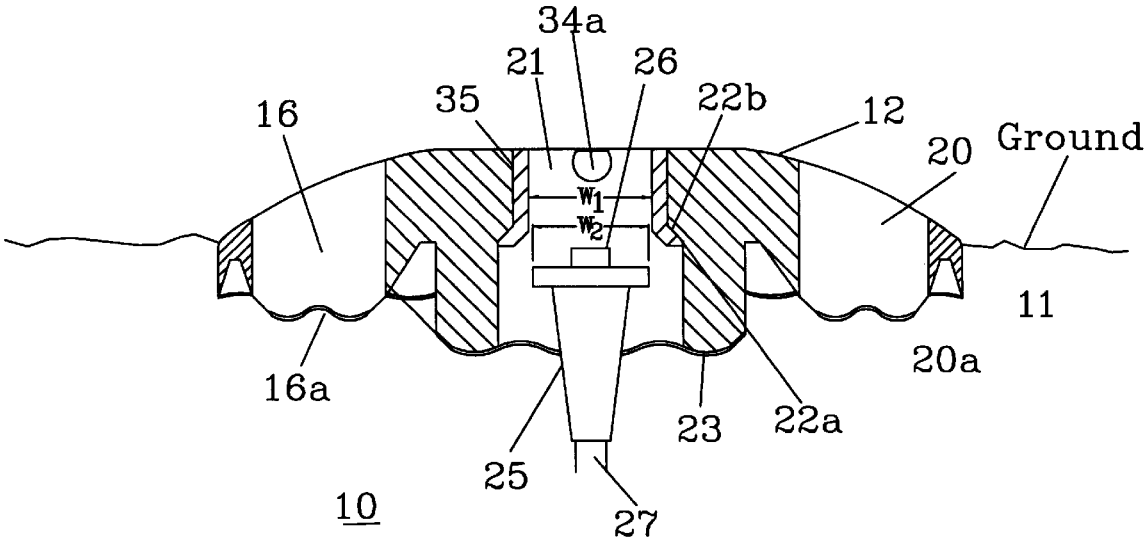
FIG. 3 is a cross-section view taken through section 3—3 of FIG. 2.

FIG. 3 is a cross-sectional view of protector 10 taken through section 3—3 of FIG. 2, Protector 10 is shown placed in the ground around sprinkler head 25 with the pop-up portion 26 of head of head 25 below the level of the top of protector 10. Sprinkler head 25 is in opening 21 in insert 35. The diameter of opening 21 will vary with the size of the sprinkler head, but in each case the diameter $W_1$ of opening 21 will be larger than the largest diameter $W_2$ of sprinkler 26. Sprinkler head vary in diameter from about one to one and one/half inch up to several inches. Therefore, at least one insert 22 is selected that corresponds to the size of the sprinkler head. More than one insert may be used to adjust the size of the opening to correspond with the diameter of the sprinkler head. Insert 22 is inserted into protector 10 from the bottom side and is moved into opening 28 in protector 10 until the shoulder 22*a* of insert 22 is against the shoulder 22*b* of opening 28. The scalloped and tapered edges 20*a*, 16*a* and 23 are illustrated in FIG. 3.

Dot or mark 34 is a bright flourescent colored marker or colored impression applied to on the inside lip of either the central opening 21 (mark 34*a*) in insert 22 or the inner wall 28*a* (mark 34*b*) of the central opening. In each case, the mark extends to the top of the opening so that it may be seen from above the protector. There may be, for example, two diagonally opposites marks in the embodiments of FIGS. 1–6, and a single mark in the embodiments of FIGS. 7 and 8. The marks 34 do not have to be round but may be any shape. The purpose of dots 34*a* and 34*b* is to help locate the protectors for maintenance reasons. The bright flourescent colors are easily spotted in grass.

Figure 4:
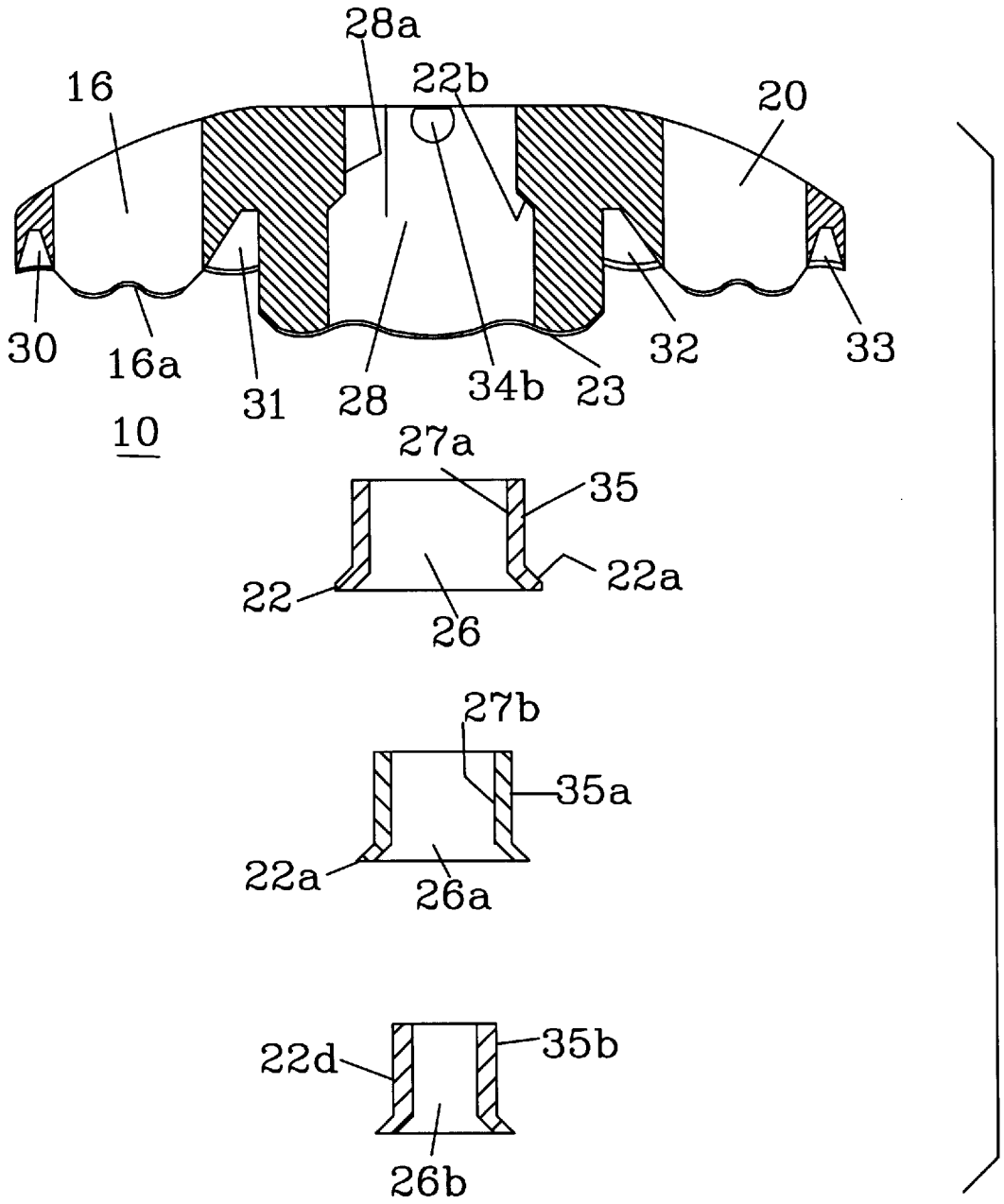
FIG. 4 is a cross-section view showing multiple inserts removed from the protector shield.

FIG. 4 is an exploded view in cross-section of protector 10 showing multiple inserts 22, 22*a* and 22*d* removed from opening 28. Shoulders 22*a* and 22*b* are adjacent to each other when insert 22 is in opening 28. The diameter of opening 28, shown at 28*a,* may be slightly tapered so that surface 35 of insert 22 may be pressed into opening 28 and held in place by the friction produced by the movement of surface 35 against tapered surface 28*a*.

Insert 22*a* is inserted into opening 26 of insert 22 to further reduce the diameter of opening 26 to the diameter of opening 26*a*. If a still smaller opening is required then insert 22*d* is inserted into opening 26*a* to reduce the opening to the diameter of opening 26*b*. Insert 22*a* has an outer surface 35*a* that is in friction contact with inner surface 27*a* of insert 22, and insert 22*d* has an outer surface 35*b* that is in frictional contact with inner surface 27*b* when all the inserts are inserted together.

Voids 30, 31, 32 and 33 shown in protector 10 are produced during molding to reduce the amount of material required in molding protector 10, and to allow soil to move up into the voids when protector 10 is pressed into the soil to prevent lateral movement of protector 10 when it is in place around a sprinkler head.

Figure 4A:
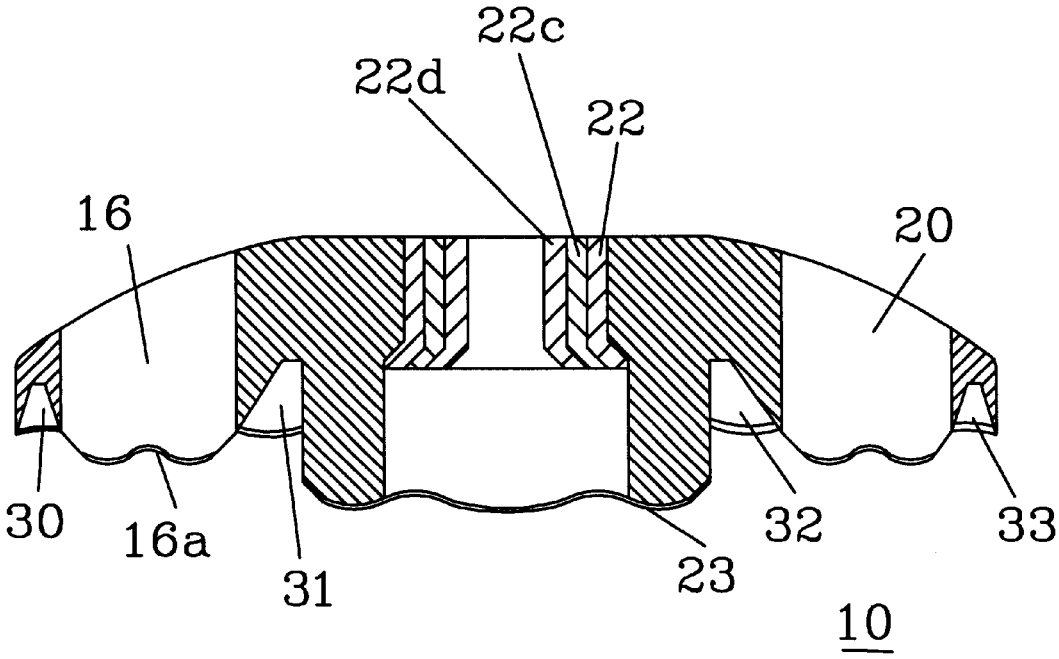
FIG. 4*a* shows the multiple inserts inserted into the protector shield.

FIG. 4*a* shows the inserts 22, 22*a* and 22*d* all inserted into protector 10. In practice, all insert may be in protector 10, and inserts are removed until the opening is large enough to accommodate the sprinkler head. Sprinkler heads usually range, for example, from about one and one-half inches to about four and one-half inches in diameter. Therefore, the opening in insert 22*d,* for example, would be slightly larger than one and one-half inches in diameter, and the opening in insert 22 would be large enough to accommodate a sprinkler head of about three and one-half inches.

Figure 5:
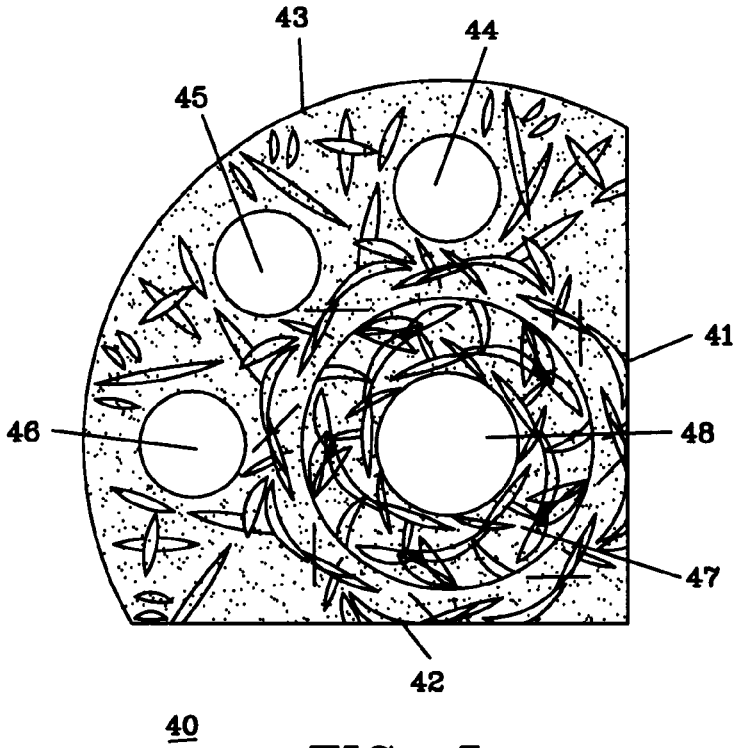
FIG. 5 is another embodiment of the invention.

FIG. 5 is another embodiment of a sprinkler head protector. Protector 40 has two straight sides 41 and 42 that form a 90 degree angle. The third side 43 is an arc joining ends of sides 41 and 42. A removable insert 47 has an opening 48 in which a sprinkler head can be placed. Protector 40 is used, for example, where two sidewalks join.

Figure 6:
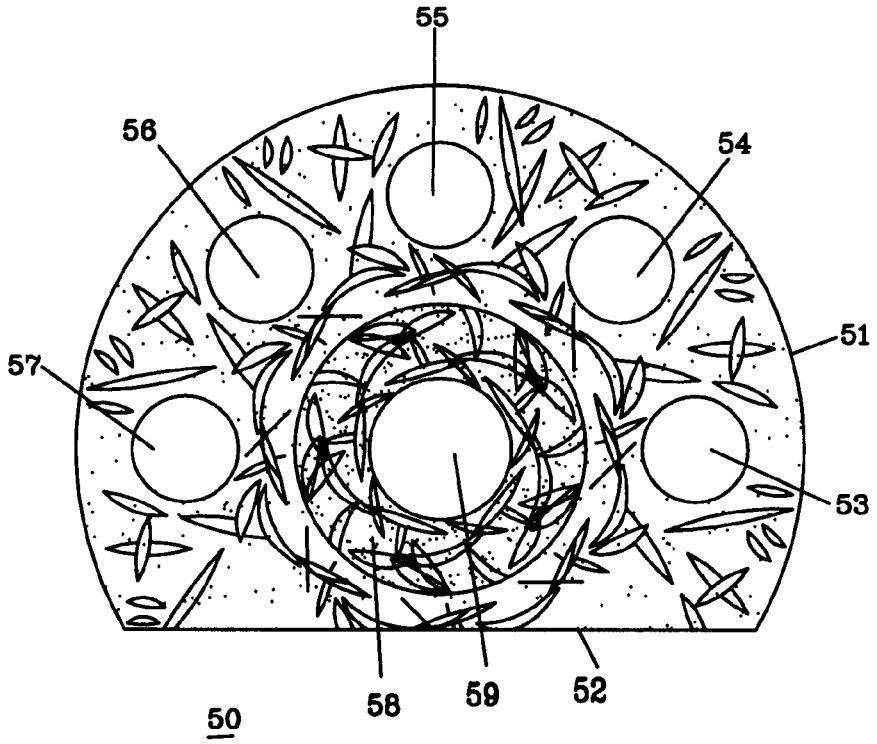
FIG. 6 is another embodiment of the invention.

In FIG. 6 another embodiment of a sprinkler head protector is illustrated. In this embodiment, sprinkler head protector 50 has a straight side 52 joined by side 51 which is part of a circle. A plurality of openings 53–57 are spaced around the surface of protector 50, and around an insert 58. Opening 59 in insert 58 is placed around a sprinkler head. Protector 50 may be used where a sprinkler head is adjacent a building, sidewalk or a flower bed border.

Figure 7:
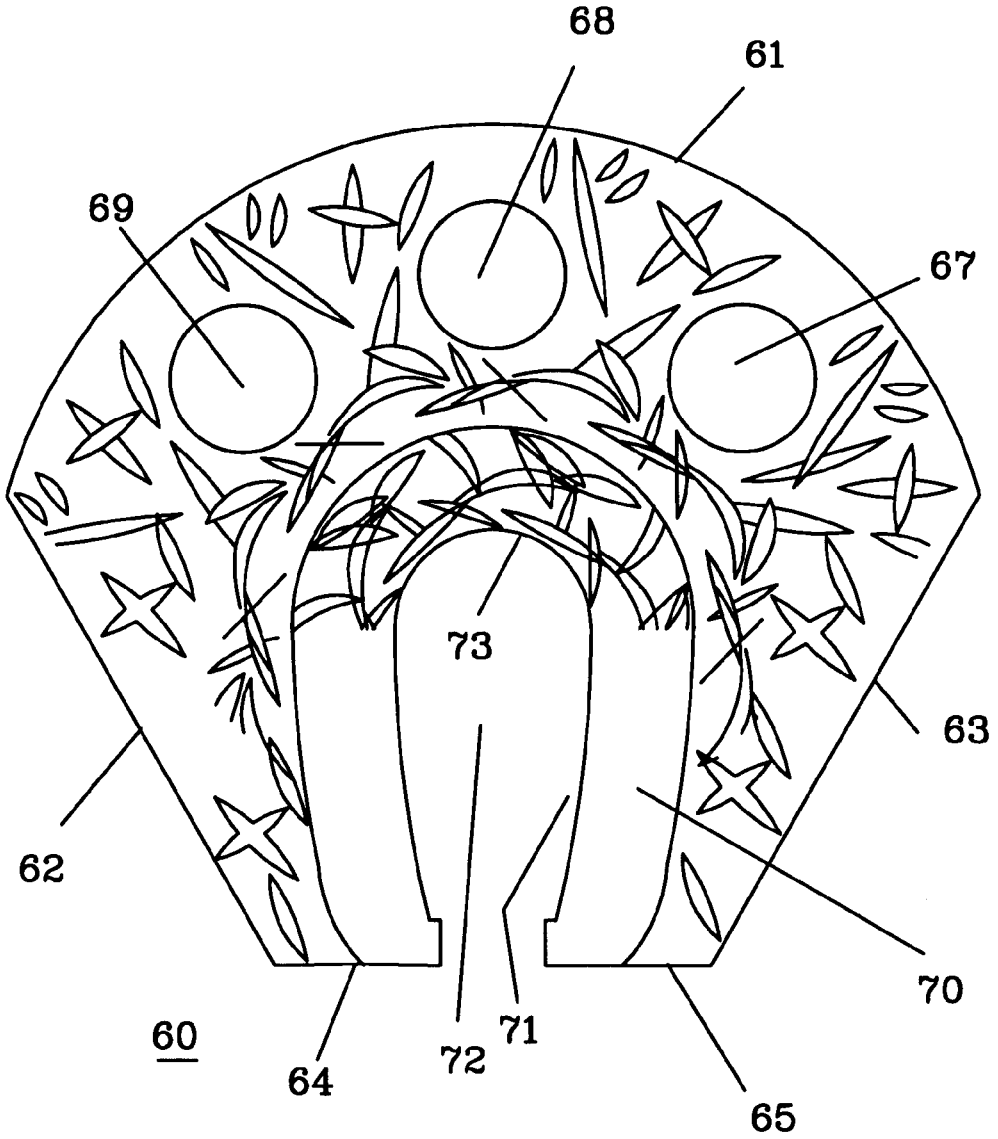
FIG. 7 is another embodiment of the invention.

FIG. 7 shows an embodiment of the invention in which the insert 70 is horseshoe shaped. Protector 60 has a curved side 61 joined on each side by tapered sides 62 and 63, each of which terminate in a small flat sides 64 and 65, respectively. Insert 70 is horseshoe shaped and is open at one end. There are three circular openings 67–69. The opening in insert 70 is elongated with one end 73 being semicircular with a diameter determined by the size of the sprinkler head to be protected.

Figure 8:
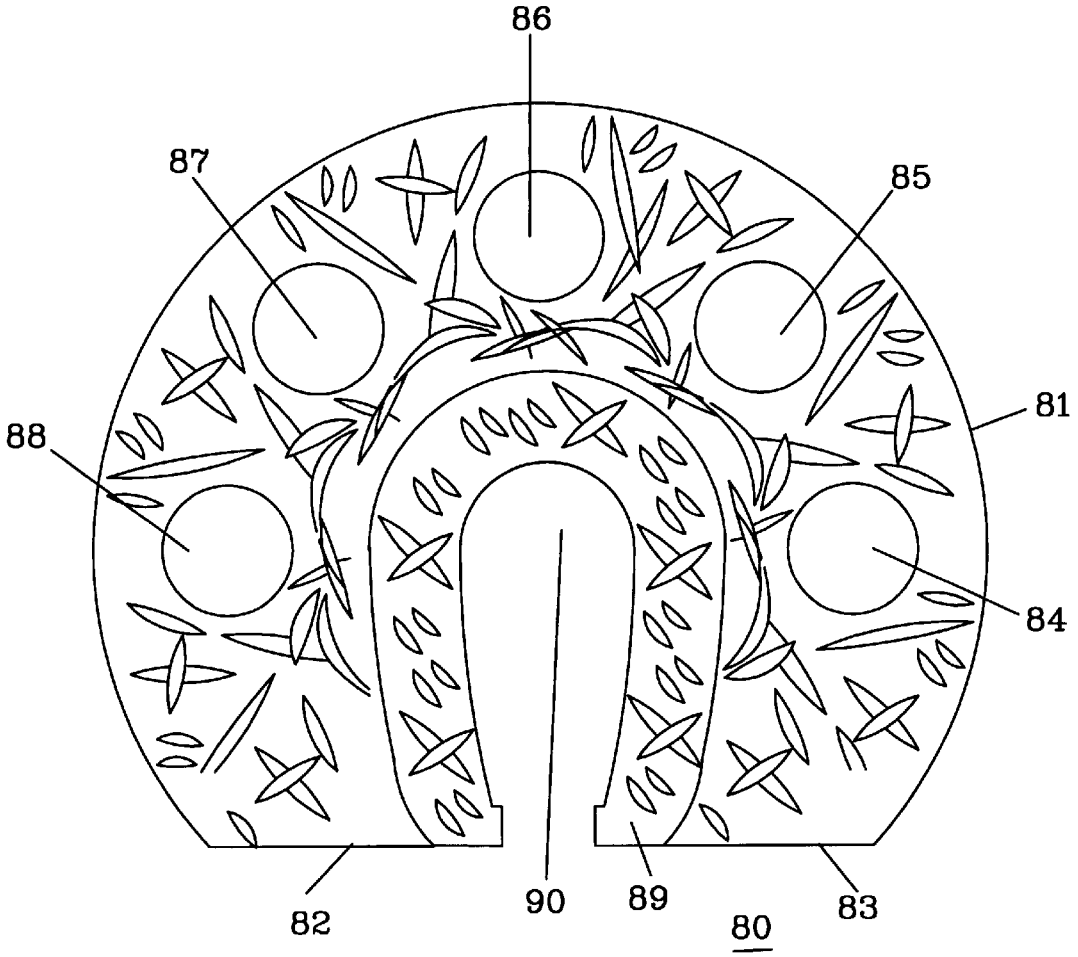
FIG. 8 is another embodiment of the invention.

FIG. 8 is a truncated circular protector with a horseshoe shaped insert 89. Protector 80 has a circular side 81 truncated with flat sides 82 and 83. Openings 84–88 are the same circular openings as in the previous embodiments. Insert 89 is similar to or the same as the insert 70 of FIG. 7.

Figure 8A:
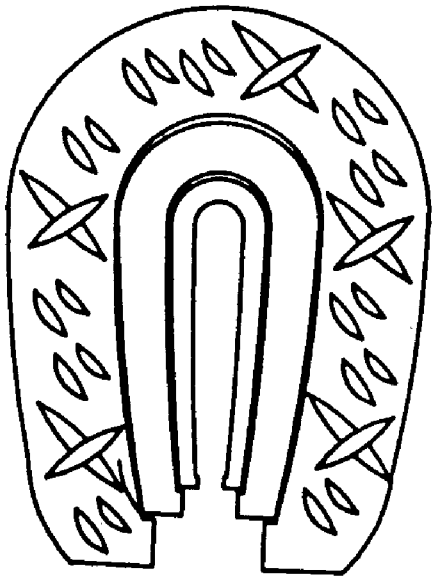
FIGS. 8*a* and 8*b* shows nesting inserts for the embodiments of FIGS. 7 and 8.
Figure 8B:
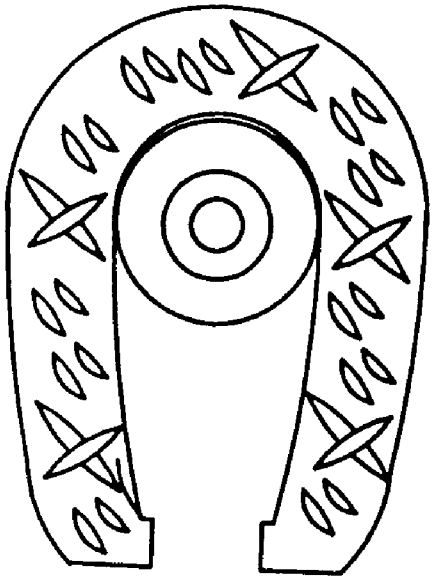

FIGS. 8*a* and 8*b* shows nesting inserts for the embodiments of FIG. 7 and FIG. 8. In FIG. 8*a,* the inserts 89*a* and 89*b* are horseshoe shaped the same as insert 89. In FIG. 8*b,* the inserts 89*c* and 89*d* are circular, and are inserted into the partially circular opening of insert 89.

Figure 9:
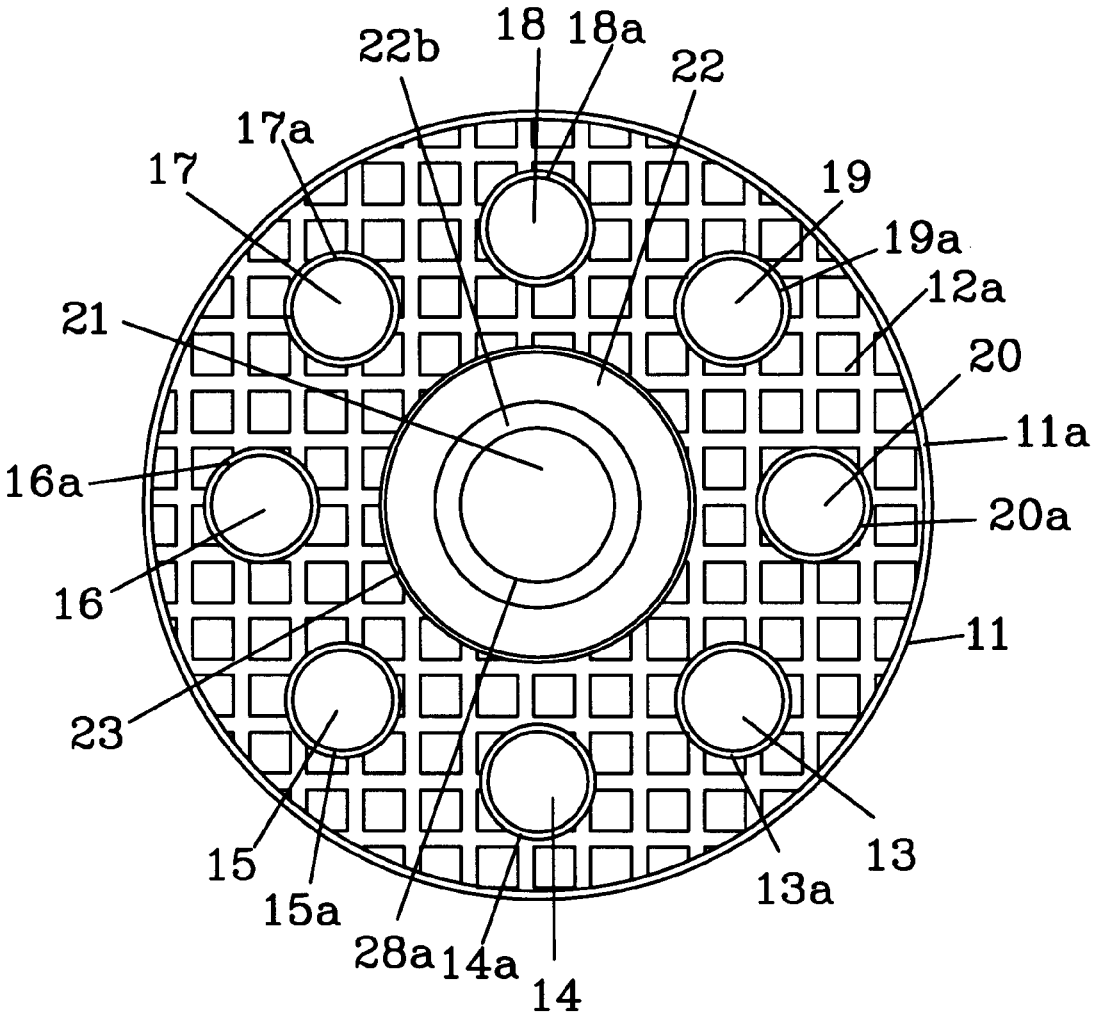
FIG. 9 shows the bottom side of the invention

FIG. 9 shows the bottom side of the sprinkler head protector. The bottom surface 12*a* is a waffle pattern to allow a thinner structure utilizing less material, yet provide a strong structure. Tapered edges 13*a*–20*a* of openings 13–20 as well as the tapered edges 11*a* and 23.

The sprinkler head protector of the described embodiment is installed as follows. An insert 35 (FIG. 4) corresponding to the size of the sprinkler head to be protected is inserted into the protector body 10. The protector 10 with insert 35 installed is placed around the sprinkler head 25 (FIG. 3) and firmly pressed into the soil around sprinkler head 25. Grass will grow up through the plurality of openings 13–20 (FIG. 3) which, in combination with the patterned surface 12, will at least partially conceal the protector. Tapered, scalloped edges 13*a*–20*a* and 23 (FIG. 1) at the bottoms of the openings help cut the grass as the protector 10 is pressed into the grass and the soil around the sprinkler head 25 (FIG. 3).

The protector has a low profile, with the top surface of the protector being a small distance, for example, less than one inch, above the surface of the ground. The sprinkler head is below the top surface of the protector when not in use. When in use it will pop-up above the surface of the protector. With the low profile protector, a lawn mower will easily pass over the protector, or a an automobile driving over a curb onto the grass cannot cruch the sprinkler head, thus protecting the sprinkler head from damage.

What is claimed is:

1. A protector shield for a lawn sprinkler head adaptable for different size sprinkler heads, comprising:

protector body having a top, bottom and side walls and a central opening in said body;

a plurality of nested inserts, one in another, in said central opening, each of said nested inserts being removable, one at a time, to accommodate sprinkler heads of different sizes, each insert having a central opening of a size in relation to the size of the sprinkler head such that the shield and insert is mounted over the sprinkler head and does not engage the sprinkler head even when the shield is tilted.

2. The protector according to claim 1, wherein said central opening, plurality of openings and said body side walls terminate in tapered edges on the bottom side of the protector shield.

3. The protector according to claim 2, wherein said tapered edges are scalloped.

4. The protector according to claim 1, wherein the top of the protector body has an indented pattern patterned with indentations which resemble grass.

5. The protector according to claim 1, wherein the top of the protector shield body is textured to provide a non-slip surface.

6. The protector according to claim 1, wherein said protector shield body has at least one flat side for positioning the protector adjacent a side walk and similar straight side objects.

7. The protector according to claim 1, wherein said protector shield body has two flat sides position at a ninety degree angle to each other for positioning the protector against a corner object.

8. A protector shield for a lawn sprinkler head adaptable for different size sprinkler heads, comprising:

a protector body having a top, bottom and side walls and a central opening in said body;

a plurality of nested inserts, nested one in another, in said central opening, each of said nested inserts being removable, one at a time, to accommodate sprinkler heads of different sizes, each insert having a central opening of a size in relation to the size of the sprinkler head such that the shield and insert is mounted over the sprinkler head and does not engage the sprinkler head even when the shield is tilted; and a plurality of openings in said body encircling said central opening extending completely through said body into which earth extend and through which grass can grow to stabilize and completely cover the shield.

9. The protector according to claim 8, wherein said central opening, plurality of openings and said body side walls terminate in tapered edges on the bottom side of the protector shield.

10. The protector according to claim 9, wherein said tapered edges are scalloped.

11. The protector according to claim 8, wherein said central opening and nested inserts have corresponding mating shoulders so to hold the inserts in place together and withing the protector body.

12. The protector according to claim 8, wherein the top of the protector body has an indented pattern patterned with indentations which resemble grass.

13. The protector according to claim 8, wherein said protector shield body has at least one flat side for positioning the protector adjacent a side walk and similar straight side objects.

14. The protector according to claim 8, wherein said body has two flat sides position at a ninety degree angle to each other for positioning the protector shield body against a corner object.

15. A protector shield for a lawn sprinkler head adaptable for different size sprinkler heads, comprising:

a protector body having a top, bottom and side walls and a central opening in said body;

a plurality of nested inserts, one in another, in said central opening, each of said nested inserts being removable, one at a time, to accommodate sprinkler heads of different size, each insert having a central opening of a size in relation to the size of the sprinkler head such that the shield and insert is mounted over the sprinkler head and does not engage the sprinkler head even when the shield is tilted; and a plurality of openings in said body encircling said central opening extending completely through said body; and tapered edges on said central opening, plurality of openings, and said body side wall, all of which terminate at the bottom of the protector shield body.

16. The protector shield according to claim 15, including a bright colored mark on the inside one of the central opening and insert to provide an easily seen mark on the protector.

17. The protector head according to claim 15, including a sidewall to entrap soil and grass under the protector to utilize them as shock absorbers when the protector is place under excessive weight.

* * * * *